US011284693B2

(12) United States Patent
Schroeder

(10) Patent No.: US 11,284,693 B2
(45) Date of Patent: Mar. 29, 2022

(54) BAG STRAP

(71) Applicant: Diane Schroeder, Hollywood, FL (US)

(72) Inventor: Diane Schroeder, Hollywood, FL (US)

( * ) Notice: Subject to any disclaimer, the term of this patent is extended or adjusted under 35 U.S.C. 154(b) by 604 days.

(21) Appl. No.: 16/020,326

(22) Filed: Jun. 27, 2018

(65) Prior Publication Data

US 2020/0000198 A1 Jan. 2, 2020

(51) Int. Cl.

| | |
|---|---|
| ***A45C 13/30*** | (2006.01) |
| ***A45C 13/26*** | (2006.01) |
| ***B65D 33/06*** | (2006.01) |

(52) U.S. Cl.

CPC ..... *A45C 13/30* (2013.01); *A45C 13/26* (2013.01); *B65D 33/06* (2013.01)

(58) Field of Classification Search

CPC ..... A45C 13/30; A45C 13/26; A45C 33/06
See application file for complete search history.

(56) References Cited

U.S. PATENT DOCUMENTS

| | | | | |
|---|---|---|---|---|
| 40,486 | A * | 3/1863 | Jones | A45F 5/00 24/298 |
| 5,722,125 | A * | 3/1998 | Vasilopoulos | A63B 60/62 150/160 |
| D530,082 | S * | 10/2006 | Sweeney | A45C 3/08 D3/246 |
| 9,480,315 | B2 * | 11/2016 | Goodale | A45C 3/08 |
| 10,233,052 | B2 * | 3/2019 | Joyner | A45F 3/04 |
| 2007/0277352 | A1 * | 12/2007 | Maron | A45F 5/00 24/298 |
| 2018/0020791 | A1 * | 1/2018 | Cole | A45C 11/00 224/576 |
| 2019/0183217 | A1 * | 6/2019 | Axelbaum | A45F 3/02 |
| 2019/0261765 | A1 * | 8/2019 | Alonzo | A45C 3/00 |

* cited by examiner

*Primary Examiner* — Tri M Mai
(74) *Attorney, Agent, or Firm* — Christopher J. Vandam PA; Chris Van Dam

(57) ABSTRACT

A bag strap that converts a clear, zippered, plastic bag into a purse or a clutch. The strap has a clip or a hook attached to each end. When hooks are used the hooks each pierce the bag below the zipper and a guard covers the tip of the hook. Where clips are used the bag is not pierced and the clips attach below the zipper. For the clutch style version both ends of the strap are joined by a single hook or clip.

4 Claims, 2 Drawing Sheets

BAG STRAP

BACKGROUND OF THE INVENTION

1. Field of the Invention

The present invention relates to hand bags, and more particularly, to a strap used to convert a plastic bag to a bag with a carry strap.

2. Description of the Related Art

Several designs for bag straps have been designed in the past. None of them, however, includes an adjustable strap with clips or hooks at each end to convert a common plastic bag into a purse or clutch.

Applicant believes that the closest reference corresponds to commercially available clear plastic bags and backpacks. However, these differ from the present invention because these prior art designs all connect to a pre-designed attachment point fabricated into the bag. Prior art designed will not work with regular plastic bags. Previous designs are not adapted to temporarily connect to any standard, disposable plastic bag to form a purse or clutch.

Other patents and prior art describing the closest subject matter provide for a number of more or less complicated features that fail to solve the problem in an efficient and economical way. None of these designs suggest the novel features of the present invention.

A brief abstract of the technical disclosure in the specification and title are provided as well for the purposes of complying with 37 CFR 1.72 and are not intended to be used for interpreting or limiting the scope of the claims.

Without limiting the scope of the invention, a brief summary of some of the claimed embodiments of the invention is set forth below. Additional details of the summarized embodiments of the invention and/or additional embodiments of the invention may be found in the detailed description of the invention below.

SUMMARY OF THE INVENTION

It is one of the main objects of the present invention to provide a device to convert a sandwich bag into a convenient purse or clutch to carry personal items.

It is another object of this invention to provide a disposable carrying device that is compatible with security checkpoints at special events, secure locations or transportation hubs.

It is still another object of the present invention to provide an economical device to carry personal items in a clear, disposable zip top bag.

It is yet another object of this invention to provide such a device that is inexpensive to manufacture and maintain while retaining its effectiveness.

Further objects of the invention will be brought out in the following part of the specification, wherein detailed description is for the purpose of fully disclosing the invention without placing limitations thereon.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE PREFERRED EMBODIMENT

Figure 1:
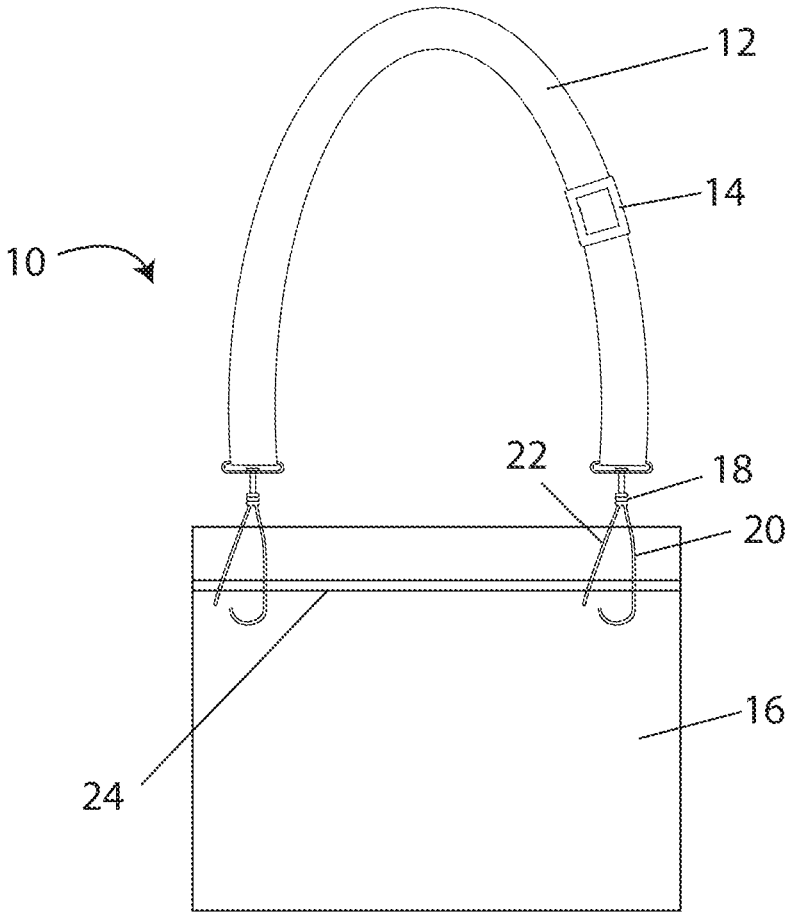
FIG. 1 shows an elevation view of a bag strap attached to a plastic zip bag forming a purse.
Figure 2:
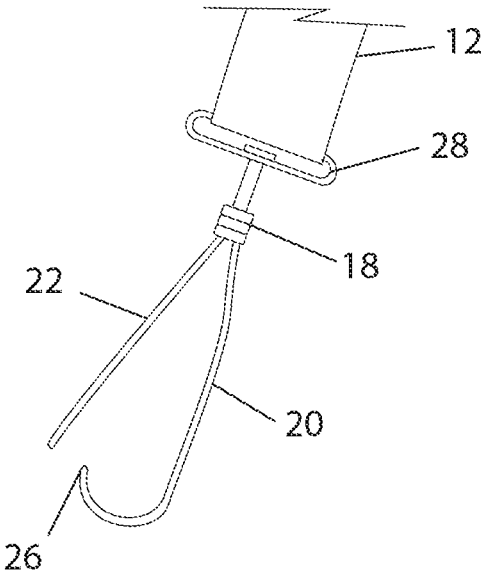
FIG. 2 shows a detail elevation view of an example of a hook used to attach a strap to a bag.

While this invention may be embodied in many different forms, there are described in detail herein specific embodiments of the invention. This description is an exemplary of the principles of the invention and is not intended to limit the invention to the particular embodiments illustrated and described.

For the purpose of this disclosure, like reference numerals in the figures shall refer to like features unless otherwise indicated or is obvious by context.

The subject device and method of use is sometimes referred to as the device, the invention, the bag strap, the strap, the purse, the clutch, the clip, the system, the machine or other similar terms. These terms may be used interchangeably as context requires and from use the intent becomes apparent. The masculine can sometimes refer to the feminine and neuter and vice versa. The plural may include the singular and singular the plural as appropriate from a fair and reasonable interpretation in the situation and context.

Modern security at secure check points, such as when entering a transportation hub, sporting event, concert or other locations, require people and bags to be searched. Opaque bags must be opened by security personnel and manually searched or require large and expensive passive imaging machines, such as an x-ray machine.

Referring now to the drawings, where the present invention is generally referred to with numeral 10, it can be observed that it basically includes across it several embodiments: a strap 12, a buckle 14, a bag 16, a swivel 18, a hook 20, a guard 22, a zipper 24, a tip 26, an eye 28, a strap 30, an eye 32, a swivel 34, a hook 36, a clasp 38, an eye 40, a hook 42, a swivel 44, a lever 46, an eye 48, a swivel 50, a clip 52 and teeth 54.

In the version of the device shown in FIG. 1, the strap 12 has a hook 22 at each end. The hook 22 has a sharp tip 26. An eye 28 and swivel 18 connect the hook 20 to the ends of the strap 12 to prevent the strap 12 from becoming twisted. A guard 22 closes over the tip 26 to protect a user of the device from being injured.

To install the device onto a bag 16 the tip 26 on one end of the strap 12 pierces the top edge of the bag 16 below the zipper 24. The guard 22 is closed to secure the hook 20 onto the bag 16. The other hook 20 on the opposite end of the strap 12 is then punched through the opposite edge of the bag 16 under the zipper 24 and the guard 22 is closed. In this way a purse is essentially formed by turning the strap 12 into a shoulder strap that can be used to carry the bag 16 and its contents visible through the clear sides of the bag 16.

The bag 16 may be a typical zipper 24 closure, resealable bag 16 commonly sold in grocery stores or may be a custom made clear bag. The zipper 24 is not required in all versions of the device but is useful both to retain the contents of the bag 16 and to provide a thicker, more robust structure near the top of the bag 16 to prevent any of the hooks 20 from tearing out of the bag 16.

A buckle 14 may be provided to adjust the length of the strap 12. This may be useful to allow the strap 12 to be customized for the comfort of any particular user of the device. Taller users may prefer a longer strap 12. Other users may prefer a shorter strap 12 to tuck the bag 16 tighter under their arm for better security of the bag.

Other styles of clips may also be effective. For example, a spring clip 52 as demonstrated in FIG. 3 or an alligator clip could be utilized to attach the ends of the strap 12 to the bag 16. With either of these styles of spring loaded clips 52 the teeth 54 may be placed over the zipper 24 to aid in keeping the clip 52 secured to the top edge of the bag 16 and avoiding unwanted slippage.

Figure 3:
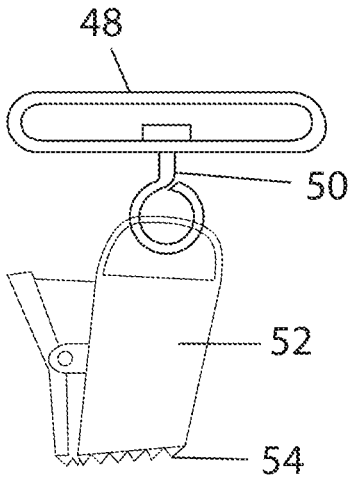
FIG. 3 shows a detail perspective view of an example of a clip used to attach a strap to a bag.

The clip in FIG. 3, similar to other versions of clips used in the various embodiment of the inventive concepts, may optionally include a swivel 50 to prevent the strap 12 from twisting. An eye 28 is also optionally provided as a connection point between the clip 52 and the ends of the strap 12.

The clip in FIG. 3 has other advantages in that it does not require piercing a hole in the bag 16. The bag may then be reused. The bag also remains more watertight to protect the dry contents. The spring clip style does not need a sharp tip 26 of the hook nor the accompanying guard 22 to protect the user from the tip 26.

Figure 5:
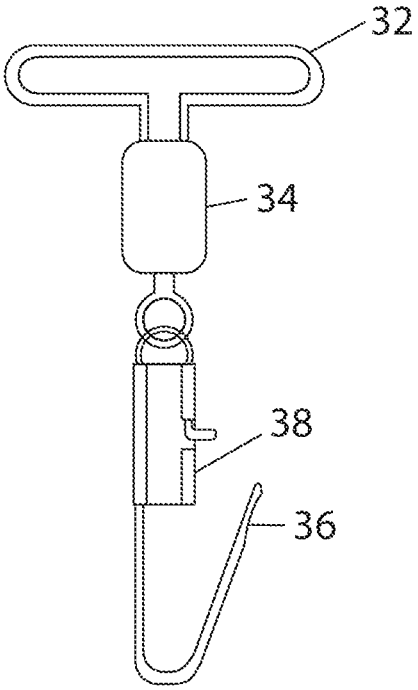
FIG. 5 shows an elevation view of an example of a hook used to attach a strap to a bag.

An alternate clip is shown in FIG. 5 that has similar features and use as the other clips. This clip includes an eye 32 to connect to the ends of the strap 12. A swivel 34 is optionally provided to allow the clip to rotate independently of the strap 12 thereby avoiding twisting the strap 12. A sharp hook 36 is provided to pierce the top of the bag 16. A clasp 38 securely holds the hook 36 when sprung into a closed position after attaching to a bag 16.

Figure 6:
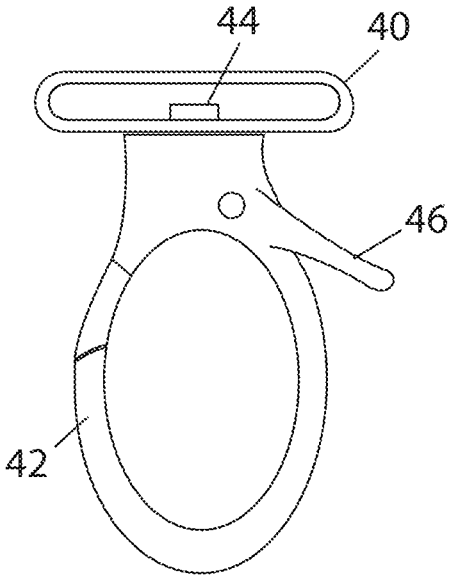
FIG. 6 shows an elevation view of an example of a hook used to attach a strap to a bag.

Yet another variation of a clip is demonstrated in FIG. 6. Pressing the lever 46 exposes the sharp tip of the hook 42. The hook 42 may then be forced through the top edge of the bag 16 in similar fashion to the completed purse viewed in FIG. 1. An eye 40 is provided to attach to the ends of the strap 12. A swivel 44 is optionally available to interconnect the hook 42 to the eye 40 to avoid tangling the strap 12, similar to other embodiments of the hooks.

Figure 4:
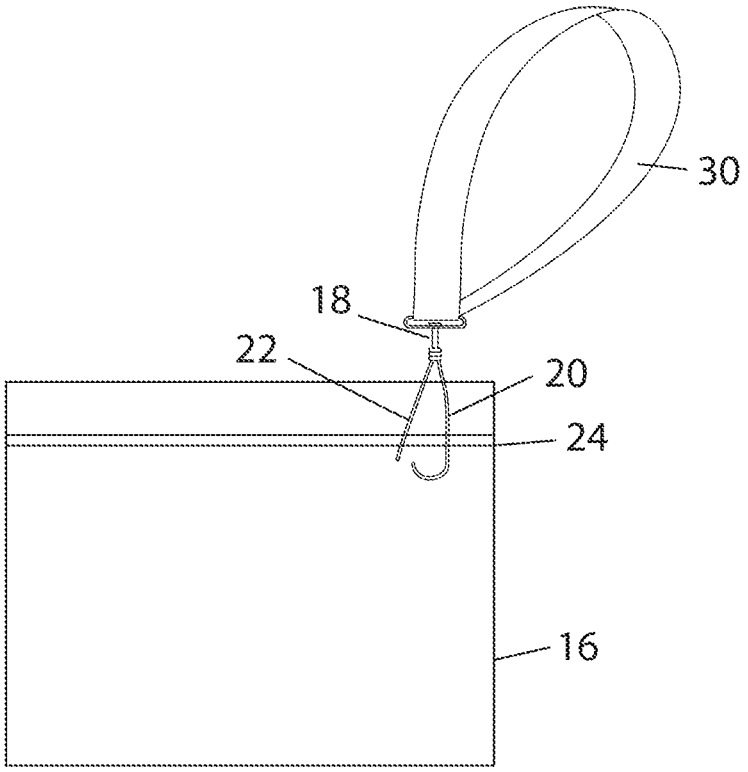
FIG. 4 shows an elevation view of a clip and strap attached to a plastic zip bag forming a clutch.

FIG. 4 illustrates clutch-style variation of the inventive concept. In this type the strap 30 has both ends affixed to a single hook 20. The bag 16 may be similar to that shown in FIG. 1 or described supra. In this version the strap 30 may optionally not have the adjustment buckle 14 as the longer, over the shoulder version in FIG. 1.

However, some users may prefer to retain the adjustable nature of the strap 30 to customize for the needs of the user. Similarly, if the adjustment feature is retained the same strap 30 could be used for both the shorter clutch-style in FIG. 4 or lengthened to be used as the over the shoulder style in FIG. 1 without the user having to have both a short and a long strap.

The strap 12 or 30 can be made of a strong and flexible material such as woven or non-woven webbing, leather, wide fabric or other similar material. Rope or cord could also be effective. Many users prefer a strap from about a half and inch wide to about two inches wide. Anywhere from about a one sixteenth diameter cord to a belt about four inches wide is effective and comfortable to wear.

The bags that the strap is adapted to work best with are disposable-style plastic sandwich bags with a zipper closure along one of the edges. These bags are commonly available at grocery stores and other outlets and are promoted for single use food storage bags. The bags are generally made of a clear plastic material such as low density polyethylene or high density polyethylene. Generally, any thin film flexible and clear plastic material formed into a bag would work with the bag strap.

These bags are widely available in sizes from about three by five inches to about twelve by twelve inches. However, the size of the bag is generally not limited by the bag strap. The weight capacity of the plastic bag and size desired by the user are controlling. An ideal size and type of bag is market as quart or gallon capacity freezer (thicker wall) zippered plastic storage bags.

An important version of the invention can be fairly described as a bag strap for carrying a disposable style bag like a purse comprised of a strap and a pair of hooks. Each of the hooks is optionally operatively affixed to a swivel. Each of the swivels is attached to an opposite end of the strap. The hooks each have a sharpened tip that pierces through an edge of the bag below a resealable zipper on the bag. The hooks each include a movable guard to protect the sharpened tip of the hook and selectively prevent the hook from removal from the bag.

Another version of the invention can be fairly described as a bag strap for carrying a disposable style bag like a clutch comprised of a strap and a hook. The hook is operatively affixed to a swivel. The swivel is attached to both opposite ends of the strap. The hook has a sharpened tip that pierces through an edge of the bag below a resealable zipper on the bag. The hook includes a movable guard to protect the sharpened tip of the hook and selectively prevent the hook from removal from the bag.

Another version of the invention can be fairly described as a bag strap for carrying a disposable style bag like a purse comprised of a strap and a clip. The clip is operatively affixed to a swivel. The swivel is attached to an end of the strap. The clip has a mouth that selectively attaches to an edge of the bag below a resealable zipper on the bag. Optionally, there may also be a second clip is affixed to a second swivel and is attached to an opposite end of the strap as the other swivel; The clips each have a mouth that selectively attach an edge of the bag below a resealable zipper on the bag.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A purse comprised of a strap and a plastic bag;

the bag is a disposable-style plastic sandwich bag with a zipper closure along a first edge of the bag;

the strap has a hook attached to both ends of the strap;

the bag is made of two facing clear plastic sheets with the zipper positioned along a first edge of the bag and a remaining perimeter of the bag is sealed resulting in an open interior;

each of the hooks is operatively affixed to a swivel;

each of the swivels is attached to an opposite end of the strap;

the hooks each have a sharpened tip that pierces through both plastic sheets of the plastic bag below the plastic zipper on the bag;

the hooks each include a movable guard to protect the sharpened tip of the hook and selectively prevent the hook from removal from the bag.

2. The bag strap of claim 1 further characterized in that the length of the strap is adjustable with a buckle.

3. A clutch comprised of a strap and a plastic bag;

the bag is a disposable-style plastic sandwich bag with a zipper closure along a first edge of the bag;

the strap is formed into a loop and is attached to a hook;

the bag is made of two facing clear plastic sheets with a plastic zipper positioned along a first edge of the bag and a remaining perimeter of the bag is sealed resulting in an open interior;

the hook is operatively affixed to a swivel;

the swivel is attached to both opposite ends of the strap;

the hook has a sharpened tip that pierces through both plastic sheets of the plastic bag below the plastic zipper on the bag;

the hook includes a movable guard to protect the sharpened tip of the hook and selectively prevent the hook from removal from the bag.

4. The bag strap of claim 3 further characterized in that the length of the strap is adjustable with a buckle.

* * * * *